US010101686B2

(12) United States Patent
Itabashi et al.

(10) Patent No.: US 10,101,686 B2
(45) Date of Patent: Oct. 16, 2018

(54) DEVELOPER CARTRIDGE HAVING HOUSING ACCOMMODATING FLEXIBLE CONTAINER FOR STORING DEVELOPER

(71) Applicant: Brother Kogyo Kabushiki Kaisha, Nagoya-shi, Aichi-ken (JP)

(72) Inventors: Nao Itabashi, Nagoya (JP); Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/472,394

(22) Filed: Mar. 29, 2017

(65) Prior Publication Data

US 2017/0285525 A1 Oct. 5, 2017

(30) Foreign Application Priority Data

Mar. 31, 2016 (JP) ..... 2016-071142

(51) Int. Cl.
*G03G 15/08* (2006.01)

(52) U.S. Cl.
CPC ..... *G03G 15/0881* (2013.01); *G03G 15/0874* (2013.01); *G03G 15/0889* (2013.01)

(58) Field of Classification Search
CPC ..... G03G 15/0841; G03G 15/0843; G03G 15/0881; G03G 15/0884; G03G 15/0889
See application file for complete search history.

(56) References Cited

U.S. PATENT DOCUMENTS

| | | | |
|---|---|---|---|
| 7,853,182 B2 | 12/2010 | Lange | |
| 9,213,263 B2 | 12/2015 | Matsuzaki et al. | |
| 2009/0142085 A1 | 6/2009 | Lange | |
| 2013/0308979 A1 | 11/2013 | Matsuzaki et al. | |
| 2014/0016961 A1 | 1/2014 | Yasui et al. | |
| 2015/0234319 A1* | 8/2015 | Matsumura | B65B 51/10 399/111 |

FOREIGN PATENT DOCUMENTS

| | | |
|---|---|---|
| JP | H05-150648 A | 6/1993 |
| JP | H11-084842 A | 3/1999 |
| JP | 2009-139946 A | 6/2009 |
| JP | 2013-037345 A | 2/2013 |

* cited by examiner

*Primary Examiner* — Hoang Ngo
(74) *Attorney, Agent, or Firm* — Banner & Witcoff, Ltd.

(57) ABSTRACT

A developer cartridge includes a first flexible container, a second flexible container, and a housing accommodating the first flexible container and the second flexible container. The first flexible container is openably sealed. The second flexible container is openably sealed. At least one of the first flexible container and the second flexible container stores developer.

25 Claims, 7 Drawing Sheets

DEVELOPER CARTRIDGE HAVING HOUSING ACCOMMODATING FLEXIBLE CONTAINER FOR STORING DEVELOPER

CROSS-REFERENCE TO RELATED APPLICATION

This application claims priority from Japanese Patent Application No. 2016-071142 filed on Mar. 31, 2016, the content of which is incorporated herein by reference in its entirety.

FIELD OF DISCLOSURE

Aspects disclosed herein relate to a developer cartridge that accommodates in its housing a flexible container storing developer.

BACKGROUND

Known developer cartridges have been used in electrophotographic image forming apparatuses that form a toner image on a recording medium. Some of such developer cartridges accommodate in their housings a developer bag (e.g., a flexible container) storing toner (e.g., developer). The flexible container is sealed before and during shipment. More specifically, the flexible container has a preformed opening (e.g., an outlet) for releasing developer therethrough and a seal member closes the opening before and during shipment. At the first use of the developer cartridge, the seal member is removed from the flexible container using an opener to release developer from the flexible container. The opener also serves as an agitator for agitating developer released from the flexible container.

SUMMARY

In known developer cartridges, generally, developer may tend to gather on one side in their housings during transportation or storage after shipment. This toner aggregation may thus cause toner deterioration, which may result in an adverse effect on image quality.

In particular, in some of the known developer cartridges, each of which stores developer in a flexible container accommodated in its housing, the flexible container may need to be opened easily and reliably when a developer cartridge is first used, whereas the flexible container may need to be untorn and surely sealed with the seal member adhering to the flexible container until the developer cartridge is first used. This may therefore restrict the design of such developer cartridges and thus may lead to increase in manufacturing cost of these developer cartridges.

According to the one or more aspects of the disclosure, a developer cartridge may include a first flexible container, a second flexible container, and a housing accommodating the first flexible container and the second flexible container. The first flexible container may be openably sealed. The second flexible container may be openably sealed. At least one of the first flexible container and the second flexible container may store developer.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

Figure 1:
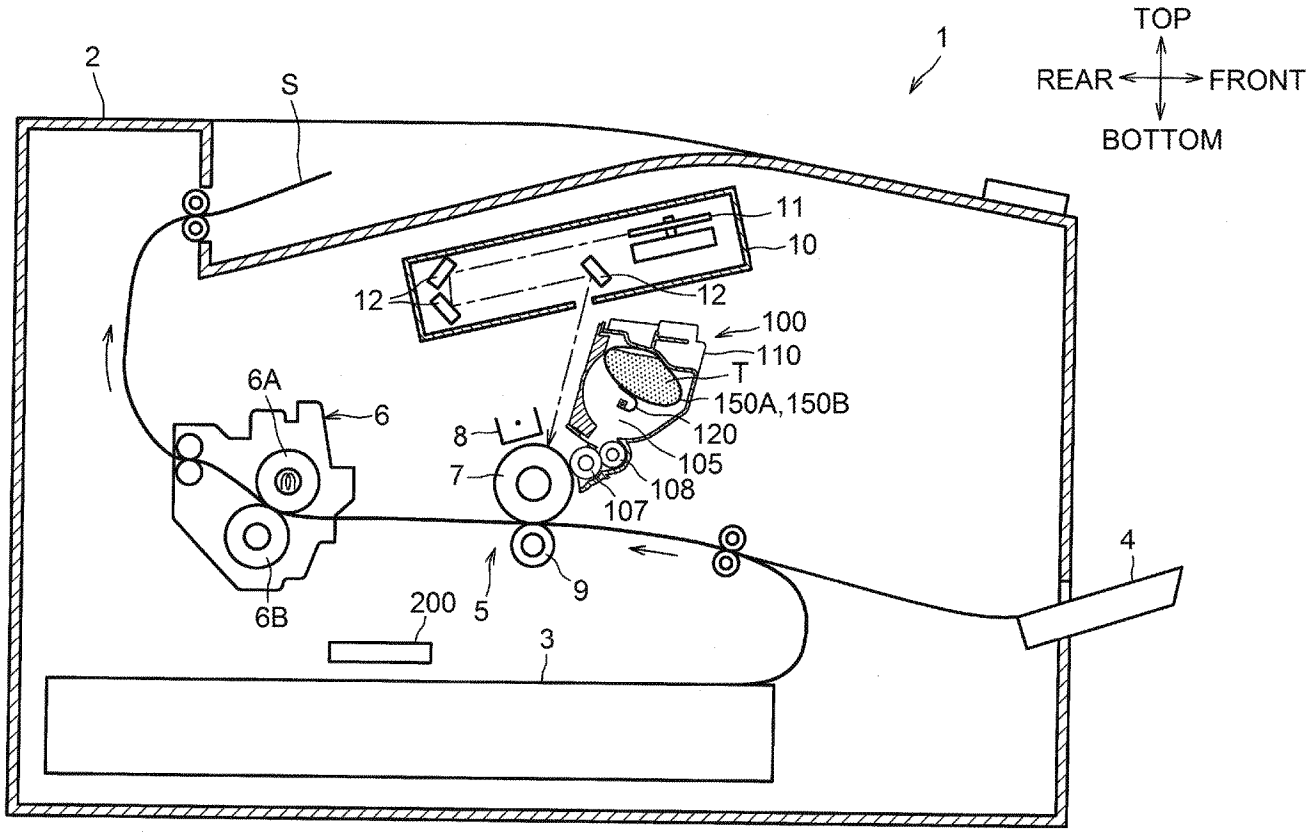
FIG. 1 is a sectional view of a laser printer in which a developer cartridge has been installed in an illustrative embodiment according to one or more aspects of the disclosure.

Hereinafter, a developer cartridge 100 according to an illustrative embodiment of the disclosure will be described. As illustrated in FIG. 1, the developer cartridge 100 is used with being attached to a laser printer 1, which is an example of an image forming apparatus.

In the following description, directions may be defined with reference to an orientation of the laser printer 1 that includes the developer cartridge 100 attached thereto and that may be disposed in an orientation in which it may be intended to be used. More specifically, a side of the laser printer 1, in which a manual feed tray 4 is provided, may be defined as the front of the laser printer 1. The right and left may be defined with respect to the laser printer 1 as viewed from the front of the laser printer 1. The top and bottom may be defined with reference to the installed orientation of the laser printer 1.

<Overall Configuration of Laser Printer>

The laser printer 1 includes a feed tray 3, the manual feed tray 4, a process unit 5, a fixing unit 6, and a controller 200 within a casing 2 thereof. The laser printer 1 is configured to form an image onto a sheet S.

The process unit 5 includes a photosensitive drum 7, a charger 8, a transfer roller 9, a scanner 10, and a developer cartridge 100. The process unit 5 is configured to form a developer image onto a sheet S.

The scanner 10 is disposed in an upper portion of the casing 2. The scanner 10 includes a laser emitter (not illustrated), a polygon mirror 11, reflectors 12, and lenses (not illustrated). The scanner 10 is configured to scan a circumferential surface of the photosensitive drum 7 with a laser beam emitted from the laser emitter via the polygon mirror 11, the reflectors 12, and the lenses as indicated by a dotted-and-dashed line.

The developer cartridge 100 includes a housing 110, flexible containers 150A and 150B, an agitator 120, a developing roller 107, and a supply roller 108. The housing 110 has a developer storage chamber 105. The flexible containers 150A and 150B each store toner T (as an example of developer) and are both accommodated in the developer storage chamber 105. The supply roller 108 is configured to supply toner T to the developing roller 107. The agitator 120, the developing roller 107, and the supply roller 108 are rotatably supported by the housing 110.

Each of the drawings according to the illustrative embodiment shows the developer cartridge 100 that has been attached to the laser printer 1 with the flexible containers 150A and 150B still being sealed. That is, each of the drawings shows the developer cartridge 100 installed in the laser printer 1 that has not been operated yet since the developer cartridge 100 was first attached thereto. In response to opening of the flexible containers 150A and 150B, toner T is released to the developer storage chamber 105 from each of the flexible containers 150A and 150B.

The developing roller 107 is disposed facing the photosensitive drum 7. The supply roller 108 rotates to supply toner T to the developing roller 107 from the developer storage chamber 105. Thus, the developing roller 107 carries toner T thereon.

The charger 8 is disposed above and spaced from the photosensitive drum 7. The transfer roller 9 is disposed below and facing the photosensitive drum 7.

The photosensitive drum 7 is positively charged by the charger 8 while rotating. Then, the circumferential surface of the photosensitive drum 7 is exposed with laser light emitted from the scanner 10, and thus an electrostatic latent image is formed thereon. Thereafter, the developing roller 107 supplies toner T onto the electrostatic latent image to form a developer image on the circumferential surface of the photosensitive drum 7. The developer image is then transferred onto a sheet S from the circumferential surface of the photosensitive drum 7 by application of a transfer bias to the transfer roller 9 while the sheet S passes between the photosensitive drum 7 and the transfer roller 9.

The fixing unit 6 is disposed downstream of the process unit 5 in a direction in which a sheet S is conveyed. The fixing unit 6 includes a fixing roller 6A and a pressure roller 6B pressed against the fixing roller 6A. The fixing roller 6A includes a heater in its cylindrical roller body. The fixing unit 6 fixes the developer image on the sheet S by application of heat by the heater while the fixing roller 6A and the pressure roller 6B hold the sheet S therebetween.

The process unit 5, the fixing unit 6, and other units or components of the laser printer 1 are controlled by the controller 200 to operate in cooperation with each other.

<Detailed Configuration of Developer Cartridge>

Hereinafter, the developer cartridge 100 will be described in detail with reference to the accompanying drawings.

Figure 2:
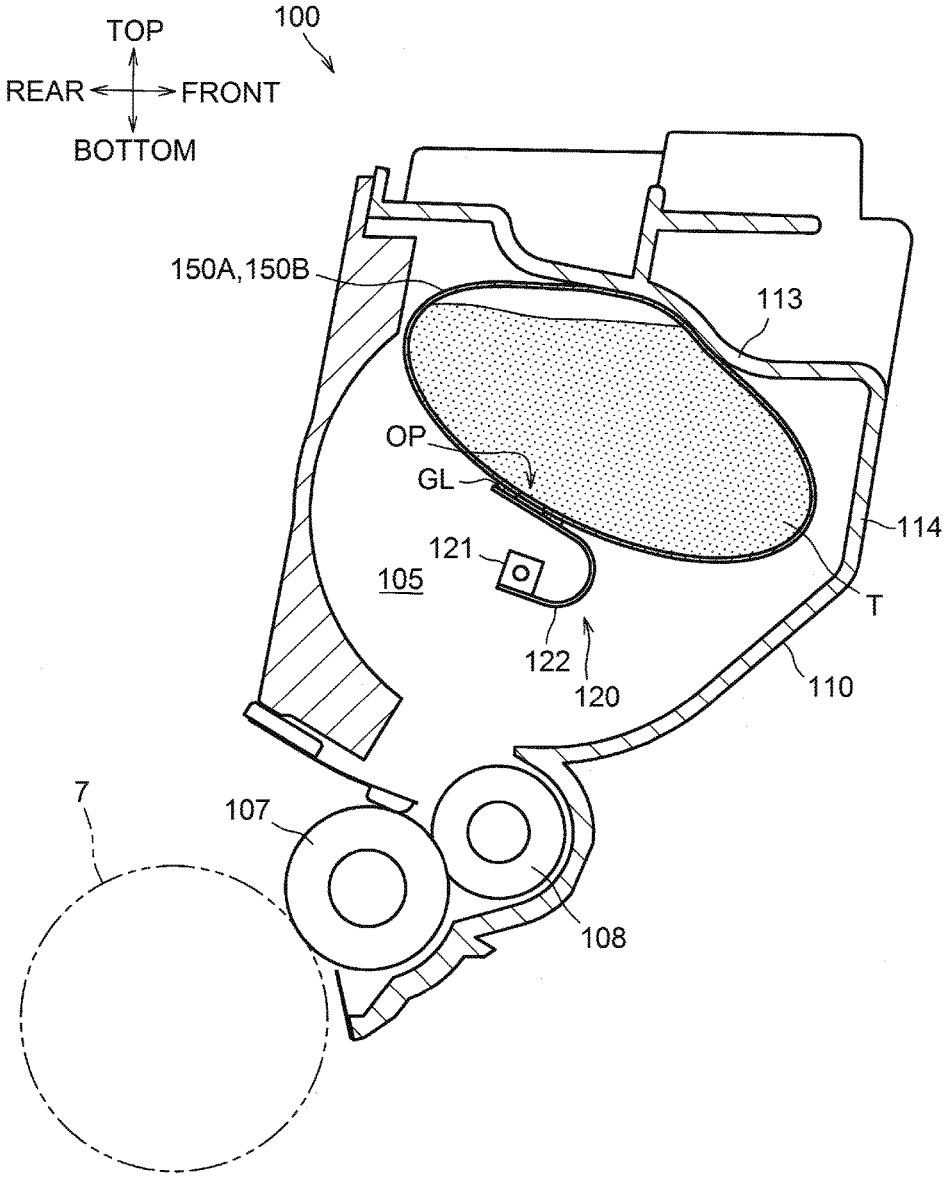
FIG. 2 is a sectional view of the developer cartridge in the illustrative embodiment according to one or more aspects of the disclosure.
Figure 3:
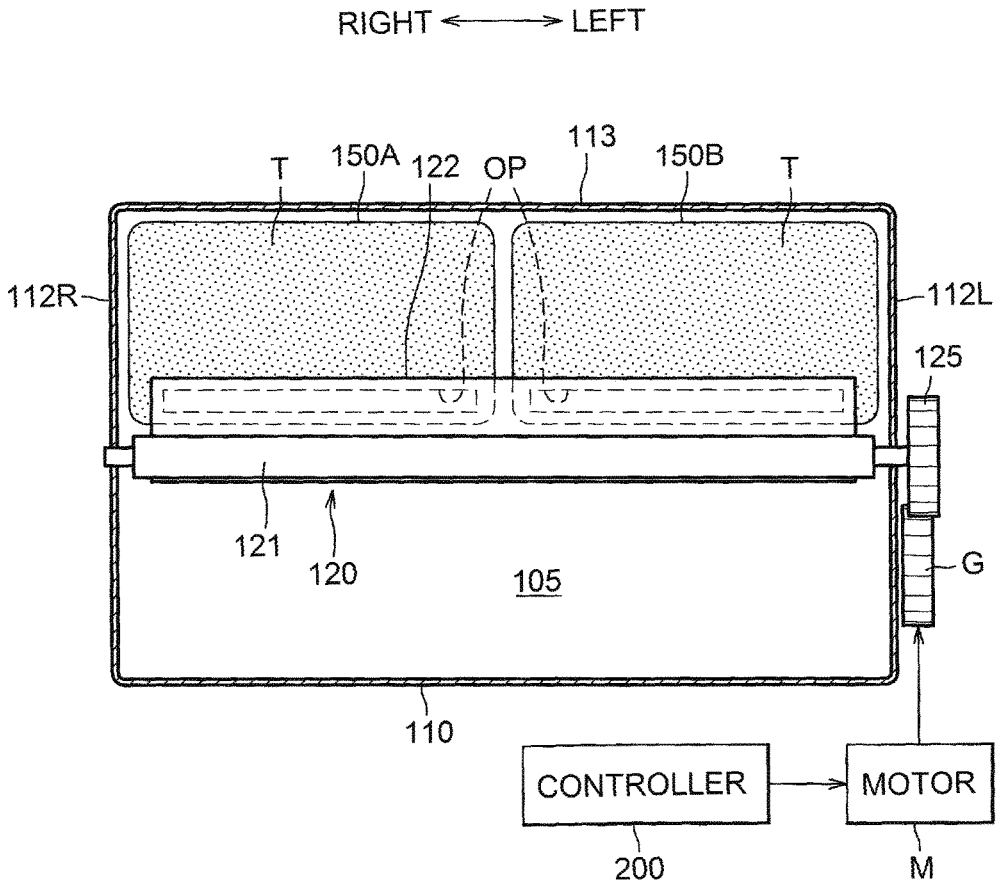
FIG. 3 is a sectional view of a developer storage chamber of the developer cartridge when viewed from front, in the illustrative embodiment according to one or more aspects of the disclosure.

As illustrated in FIGS. 2 and 3, the developer cartridge 100 includes a plurality of, for example, two flexible containers 150A and 150B, which are fixed to an interior of the housing 110. The flexible container 150A is an example of a first flexible container, and the flexible container 150B is an example of a second flexible container.

Each of the flexible containers 150A and 150B is a hermetically sealed bag-like container that stores toner T. The flexible containers 150A and 150B may be broadly interpreted to encompass any containers that are made of material having elastically or plastically deformable property and thus are easier to deform than the housing 100 having a relatively high stiffness.

Each of the flexible containers 150A and 150B has an outlet OP in its bottom portion. Toner T is allowed to be released to the developer storage chamber 105 through the outlet OP. The flexible containers 150A and 150B are fixed to an upper wall 113 of the housing 110.

Each of the flexible containers 150A and 150B may be made of, for example, polyethylene terephthalate (PET), polyethylene (PE), or polypropylene (PP). The material used for each of the flexible containers 150A and 150B is not limited to the specific examples. In other embodiments, for example, an elastic material, e.g., rubber, may be used for a portion or an entire body of each of the flexible containers 150A and 150B. In other embodiments, for example, each of the flexible containers 150A and 150B may include a portion having a higher stiffness than the other portion made of flexible material, or may include an embedded elastic member, e.g., a spring. The material used for the flexible containers 150A and 150B is determined appropriately in consideration given to, for example, sealing performance of the flexible containers 150A and 150B suitable for the properties of a substance to be stored therein, or a contracting property of the flexible containers 150A and 150B after opened.

In the illustrative embodiment, the flexible containers 150A and 150B may be made of the same material and may have an identical shape. The flexible containers 150A and 150B are aligned next to each other in a right-left direction (e.g., in a direction in which a rotation axis of the agitator 120 extends (hereinafter, referred to as a "rotation axis direction of the agitator 120")). The flexible containers 150A and 150B are both filled to near capacity with toner T having the same composition. That is, the flexible containers 150A and 150B store the same amount of toner T.

The agitator 120 is disposed below the flexible containers 150A and 150B, and is configured to agitate toner T released to the developer storage chamber 105. The agitator 120 includes an agitator shaft 121, an agitation sheet 122, and an agitator gear 125. The agitation sheet 122 has one end portion that is fixed to the agitator shaft 121. The agitation sheet 122 is configured to rotate together with the agitator shaft 121.

The agitator shaft 121 has end portions that are rotatably supported by sidewalls 112L and 112R of the housing 110 via respective seal bearings having a sealing function (not illustrated). One of the end portions of the agitator shaft 121 protrudes beyond the left sidewall 112L of the housing 110. The agitator gear 125 is fixedly attached to the exposed end portion and is in mesh with a gear G.

The agitation sheet 122 has the other end portion (e.g., a free end portion) that is removably adhered to edge portions of the outlets OP of both of the flexible containers 150A and 150B using adhesive GL. In other words, the free end portion of the agitation sheet 122 has a sealing function for sealing the flexible containers 150A and 150B as well as the agitating function.

At the first use of the developer cartridge 100, the agitation sheet 122 that closes the outlets OP of the flexible containers 150A and 150B is removed therefrom to open both of the outlets OP at substantially the same timing. More specifically, the agitation sheet 122 is removed from the flexible containers 150A and 150B by rotation of the agitator shaft 121. The agitator shaft 121 is configured to rotate by input of a driving force to the agitator gear 125 via the gear G by rotation of a motor M started in response to generation of an image forming instruction by the controller 200.

In response to opening of the outlets OP of both of the flexible containers 150A and 150B by removal of the free end portion of the agitation sheet 122 from the edge portions of the outlets OP, toner T is released to the developer storage chamber 105 from each of the flexible containers 150A and 150B. The released toner T is agitated by the moving agitation sheet 122 of the agitator 120.

According to the illustrative embodiment, the following effects may be obtained.

Toner T may be stored in the hermetically sealed flexible containers 150A and 150B within the housing 110. This configuration may therefore simplify packaging for the developer cartridge 100.

During storage or transportation of a developer cartridge that accommodates in its housing a single flexible container (e.g., a flexible bag) storing the whole amount of toner, generally, drop impacts or pressure from the bag holding the weight of toner may act on the stored toner. This may thus tend to cause toner aggregation in the flexible container. In particular, if such a developer cartridge is stocked in an orientation in which the longer sides of the flexible container along an axial direction of an agitator extend vertically, toner's own weight may act on toner particles at a lower portion of the flexible container in the direction of gravity and toner may form a lump locally in the flexible container.

In the illustrative embodiment, as opposed to this, toner T is distributed among the two sealed flexible containers 150A and 150B for storage in the housing 110. This configuration may therefore reduce or minimize gathering of toner T on one side and aggregation of toner T caused by toner's own weight in the developer cartridge 100.

In particular, in the illustrative embodiment, the flexible containers 150A and 150B are aligned next to each other in the right-left direction. This arrangement may therefore reduce or minimize gathering of toner T on one side in the rotation axis direction of the agitator 120. Accordingly, the configuration according to the illustrative embodiment may reduce or minimize an adverse effect on image quality that may be caused by toner deterioration or uneven toner supply due to aggregation of toner T.

If a developer cartridge includes only a single flexible container for toner storage, the flexible container needs to have capacity for storing the whole amount of toner T. Nevertheless, in the illustrative embodiment, the developer cartridge 100 includes the two flexible containers 150A and 150B. Therefore, each of the flexible containers 150A and 150B has capacity for storing one half of the whole amount of toner T. That is, the weight of toner T stored in each of the flexible containers 150A and 150B is half of the weight of toner T stored in the single flexible container that stores the whole amount of toner T. Therefore, a relatively high strength (e.g., load capacity) might not be required of the material used for the flexible containers 150A and 150B. This may thus achieve a relatively low cost of manufacturing the flexible containers 150A and 150B.

In the illustrative embodiment, the outlet OP is preformed in each of the flexible containers 150A and 150B and is closed by the seal member. Thus, the position, shape, and size of the outlet OP through which toner T is released when the outlet OP is opened may be determined appropriately. This appropriate determination may therefore ensure smooth release of toner T to the developer storage chamber 105 through the outlet OP of each of the flexible containers 150A and 150B.

In the illustrative embodiment, the agitation sheet 122 of the agitator 120 closes both of the outlets OP of the flexible containers 150A and 150B. Therefore, both of the outlets OP may be opened at substantially the same timing using a driving force of the agitator 120. Thus, such a configuration requires no external driving force for opening the outlets OP in addition to the driving force for driving the agitator 120 nor individual seal member for closing each of the outlets OP. Therefore, the outlet OP of each of the flexible containers 150A and 150B may be opened with such a simple configuration at the first use of the developer cartridge 100.

In the illustrative embodiment, the agitation sheet 122 of the agitator 120 also serves as the seal member for closing both of the outlets OP of the flexible containers 150A and 150B. More specifically, as the seal member, the agitation sheet 122 closes both of the outlets OP of the flexible containers 150A and 150B until removed to open the flexible containers 150A and 150B. After the agitation sheet 122 is removed from the flexible containers 150A and 150B, the agitation sheet 122 agitates toner T released through the outlets OP, as the agitating member. That is, a single member may serve as both the agitating member and the seal member. This configuration may therefore achieve reduction of parts count and reduction of manufacturing cost of the developer cartridge 100.

Figure 4:
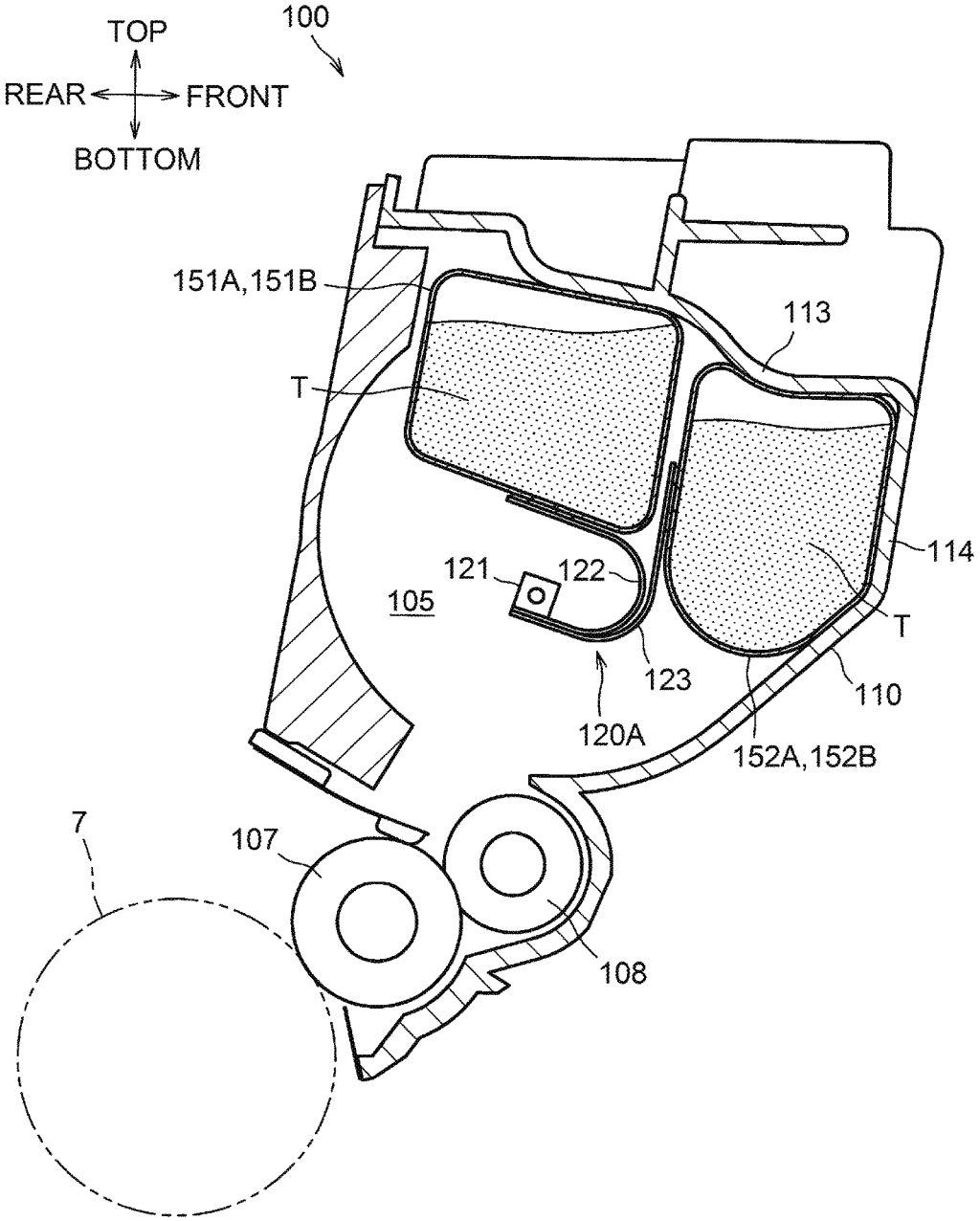
FIG. 4 is a sectional view of a developer cartridge in a first alternative embodiment according to one or more aspects of the disclosure, illustrating relative positions of flexible containers.
Figure 5:
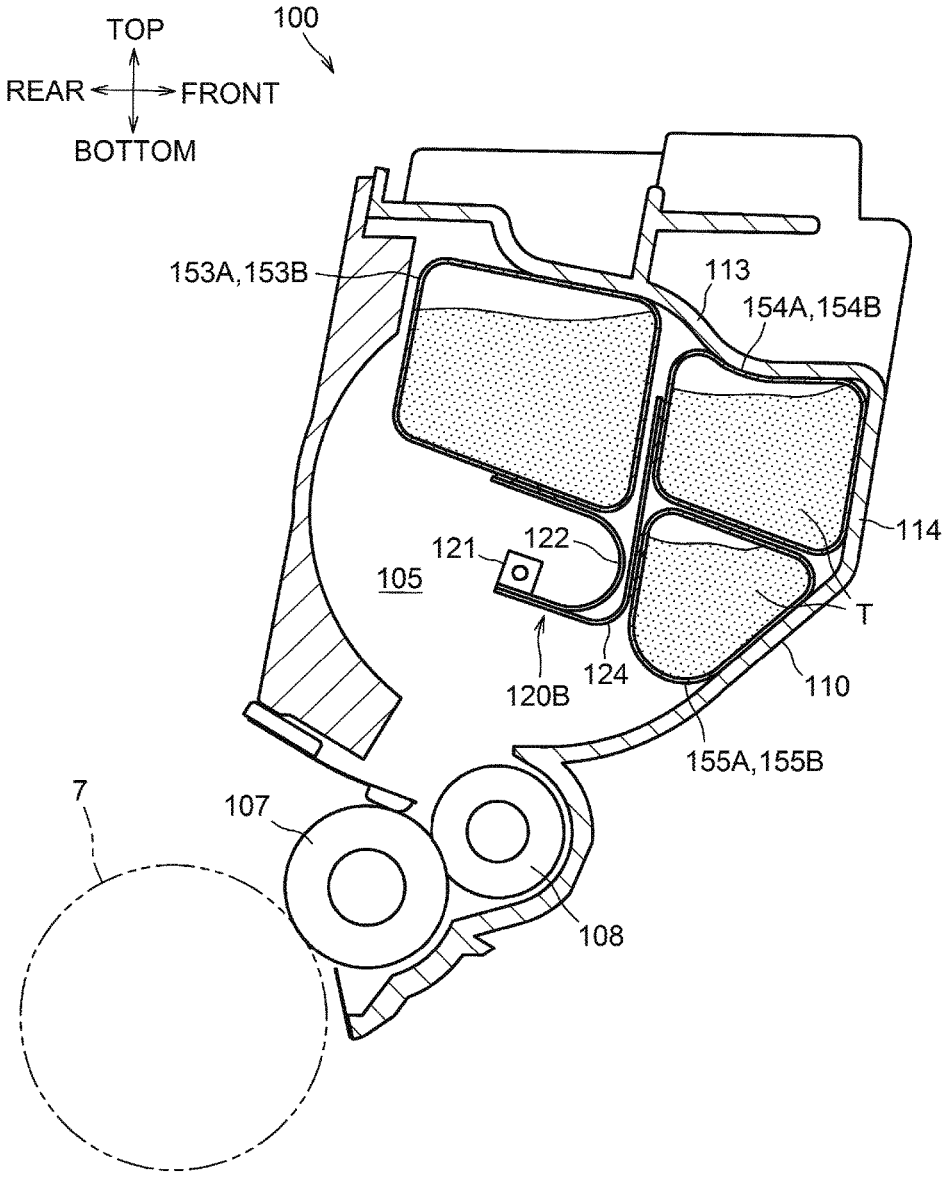
FIG. 5 is a sectional view of a developer cartridge in a second alternative embodiment according to one or more aspects of the disclosure, illustrating relative positions of flexible containers.
Figure 6:
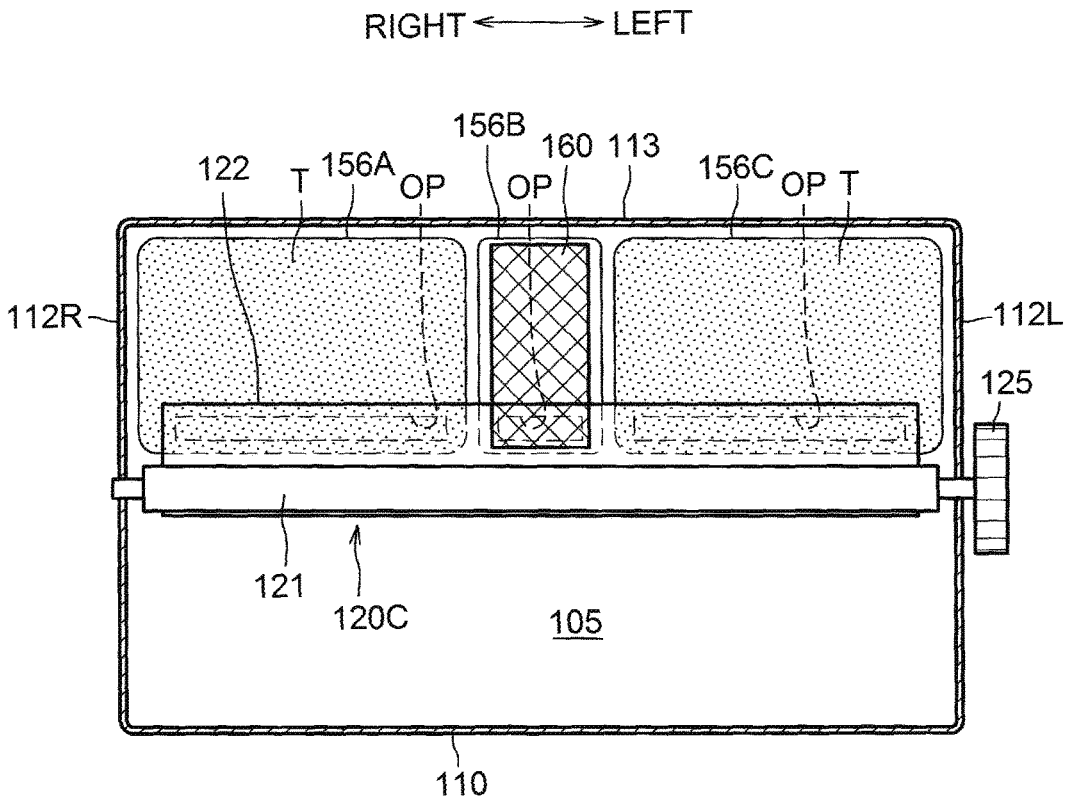
FIG. 6 is a sectional view of a developer storage chamber of a developer cartridge in a third alternative embodiment according to one or more aspects of the disclosure, illustrating relative positions of flexible containers when viewed from front.

Referring to FIGS. 4, 5, and 6, alternative embodiments will be described. In the alternative embodiments, the number of flexible containers, arrangement, and structure of flexible containers are different from the illustrative embodiment. Therefore, an explanation will be given mainly for the components different from the illustrative embodiment, and an explanation will be omitted for the common components by assigning the same or similar reference numerals thereto.

First Alternative Embodiment

In a first alternative embodiment, a developer cartridge accommodates four flexible containers within its housing, and two of the flexible containers are aligned next to each other in a front row and the other two of the flexible containers are aligned next to each other in a rear row. The front and rear rows are next to each other in the front-rear direction. More specifically, for example, as illustrated in FIG. 4, a developer cartridge 100 includes four flexible containers 151A, 151B, 152A, and 152B, and the two flexible containers 151A and 151B are aligned next to each other in a rear row, and the other two flexible containers 152A and 152B are aligned next to each other in a front row. The rear flexible containers 151A and 151B are both fixed to the upper wall 113 of the housing 110. The front flexible containers 152A and 152B are both fixed to the upper wall 113 and a front wall 114 of the housing 110.

An agitator 120A includes two agitation sheets 122 and 123, each of which has a free end portion functioning as a seal member (e.g., a first seal member or a second seal member). The free end portion of the agitation sheet 122 removably seals both of the flexible containers 151A and 151B. The free end portion of the agitation sheet 123 removably seals both of the flexible containers 152A and 152B. All of the four flexible containers 151A, 151B, 152A, and 152B are opened at substantially the same timing in conjunction with rotation of the agitator 120A (e.g. a movable portion).

In the first alternative embodiment, toner T is distributed among the four flexible containers 151A, 151B, 152A, and 152B for storage in the developer cartridge 100. Thus, each of the flexible containers 151A, 151B, 152A, and 152B stores further less amount of toner T as compared with the flexible containers 150A and 150B of the illustrative embodiment. Therefore, this configuration may reduce or minimize gathering of toner T on one side and aggregation of toner T further effectively.

In the first alternative embodiment, the flexible containers 151A, 151B, 152A, and 152B are arranged in the front and rear rows that are next to each other in the front-rear direction (i.e., in a direction orthogonal to the rotation axis direction of the agitator 120). This arrangement may therefore reduce or minimize gathering of toner T on one side in the front-rear direction in addition to gathering of toner T on one side in the right-left direction.

The rear flexible containers 151A and 151B have a different shape from the front flexible containers 152A and 152B. That is, the flexible containers 151A, 151B, 152A, and 152B have a shape suitable for an internal shape of the developer storage chamber 105. Forming the flexible containers 151A, 151B, 152A, and 152B in such shapes may thus enable effective use of the internal space of the developer storage chamber 105.

In the first alternative embodiment, all of the flexible containers 151A, 151B, 152A, and 152B have the same storage capacity. In one example, the flexible containers 151A, 151B, 152A, and 152B may have respective different shapes suitable for the internal shape of the developer storage chamber 105. The flexible containers 151A, 151B, 152A, and 152B may be undeformable but have the same storage capacity. In another example, the flexible containers 151A, 151B, 152A, and 152B may have an identical shape and have the same storage capacity. The flexible containers 151A, 151B, 152A, and 152B may be deformable suitably to the internal shape of the developer storage chamber 105 when attached to the developer storage chamber 105. Using the identical flexible containers, i.e., providing commonality among the flexible containers, may implement mass production and this may thus achieve cost advantages.

Second Alternative Embodiment

In a second alternative embodiment, a developer cartridge accommodates six flexible containers within its housing. More specifically, for example, as illustrated in FIG. 5, a developer cartridge 100 includes six flexible containers 153A, 153B, 154A, 154B, 155A, and 155B. The flexible containers 153A and 153B are aligned next to each other in a rear row. The flexible containers 154A and 154B are aligned next to each other in an upper front row. The flexible containers 155A and 155B are aligned next to each other in a lower front row. The rear flexible containers 153A and 153B are both fixed to the upper wall 113 of the housing 110. The upper front flexible containers 154A and 154B are both fixed to the upper wall 113 and the front wall 114 of the housing 110. The lower front flexible containers 155A and 155B are both fixed to the front wall 114 of the housing 110.

An agitator 120B includes two agitation sheets 122 and 124, each of which has a free end portion functioning as a seal member. The free end portion of the agitation sheet 122 removably seals both of the flexible containers 153A and 153B. While the free end portion of the agitation sheet 124 removably seals both of the flexible containers 154A and 154B, a middle portion of the agitation sheet 124 seals both of the flexible containers 155A and 155B. With this configuration, all of the six flexible containers 153A, 153B, 154A, 154B, 155A, and 155B are opened at substantially the same timing in conjunction with rotation of the agitator 120B.

In the second alternative embodiment, toner T is distributed among the six flexible containers 153A, 153B, 154A, 154B, 155A, and 155B for storage in the developer cartridge 100. Therefore, each of the flexible containers 153A, 153B, 154A, 154B, 155A, and 155B may store further less amount of toner T as compared with the flexible containers 151A, 151B, 152A, and 152B of the first alternative embodiment. In the second alternative embodiment, the front space in the developer storage chamber 105 may be used for storage of toner T with the least wasted space.

In the second alternative embodiment, the flexible containers 154A, 154B, 155A, and 155B are arranged in the upper and lower front rows (i.e., in a direction orthogonal to the rotation axis direction of the agitator 120). This arrangement may therefore enable increase of storage capacity for total amount of toner T in the developer cartridge 100 by an effective use of the internal space of the developer storage chamber 105.

The number, position, shape, and size (or capacity) of any flexible containers accommodated in the housing 110 are not limited to the specific examples disclosed in the illustrative embodiment or the alternative embodiments. For example, one or three or more flexible containers may be included in a single row that extends in the right-left direction. The flexible containers may be arranged in three or more rows that are next to each other in the front-rear direction or in the top-bottom direction. In another example, flexible containers may be situated opposite to each other across an agitator in the top-bottom direction and in the front-rear direction. This arrangement may maximize the use of the internal space of the developer storage chamber 105, which may enable further increase of storage capacity for total amount of toner T in the developer cartridge 100.

In the illustrative embodiment and the first and second alternative embodiments, all of the flexible containers store toner T. Nevertheless, in other embodiments, for example, one or more of the flexible containers may store therein a substance other than toner T. Hereinafter, an example in which an additional function is implemented by a substance (other than toner T) stored in one of flexible containers will be described.

Third Alternative Embodiment

In a third alternative embodiment, three flexible containers are aligned next to each other in the right-left direction. As illustrated in FIG. 6, for example, a developer cartridge 100 accommodates three flexible containers 156A, 156B, and 156C in its developer storage chamber 105. The flexible containers 156A, 156B, and 156C are aligned next to each other in the right-left direction (e.g., the rotation axis direction of an agitator 120C). The middle flexible container 156B is smaller than the other flexible containers 156A and 156C.

The flexible containers 156A and 156C are filled to near capacity with toner T having the same composition. That is, the flexible containers 156A and 156C store the same amount of toner T. The flexible container 156B accommodates a breathable basket 160 that stores silica gel granules as a dehumidifying agent. The basket 160 is fixed to the upper wall 113 of the housing 110 together with the flexible container 156B. The basket 160 is retained at the position after the flexible container 156B is opened. The basket 160 is an example of a third container.

The silica gel granules are stored in the sealed flexible container 156B. The flexible container 156B is opened at the same timing as opening of the other flexible containers 156A and 156B each storing toner T (i.e., at the first use of the developer cartridge 100). This configuration may therefore minimize degradation in the dehumidifying performance of the silica gel granules while the developer cartridge 100 is stocked, and may enable the silica gel granules to reliably provide their dehumidifying performance to toner T after the developer cartridge 100 is started to be used.

Nevertheless, any substance may be accommodated in the basket 160. In other embodiments, for example, the substance may be an aromatic or a deodorant. Storing any substance other than toner T in at least one of the flexible containers may implement an additional function (e.g., dehumidification, deodorization, or pleasant smell) in connection with the start of using the developer cartridge 100.

In another example, each of the flexible containers 156A and 156C may store toner T containing no additive, and the flexible container 156B may accommodate no basket 160 but may store an appropriate additive that may be mixed into toner T preferably immediately before use of toner T because of the characteristics of toner T. The additive may be, for example, silica, or carrier to be used for two component development. In this case, also, all of the flexible containers 156A, 156B, and 156C are opened at substantially the same timing.

In the illustrative embodiment and the alternative embodiments, the agitator 120 functions as the opening mechanism and the seal member. More specifically, the agitator shaft (e.g., the agitator shaft 121 of each of the agitators 120, 120A, 120B, and 120C) that is the movable portion configured to move in response to input of a driving force from the outside of the housing 110 via the agitator gear 125 functions as the opening mechanism. The agitation sheet (e.g., the agitation sheet 122, 123, or 124) closes the outlets OP of two or more of the flexible containers, as the seal member. The two or more of the flexible containers are opened at substantially the same timing by removal of such an agitation sheet. Nevertheless, the opening mechanism and the seal member might not necessarily be implemented by the agitator. In other embodiments, for example, a plurality of flexible containers may be opened at respective different timings. More specifically, for example, the flexible containers may be opened consecutively one after another or may be opened individually at their appropriate different timings.

Hereinafter, another alternative embodiment in which a different opening mechanism is used will be described.

Figure 7:
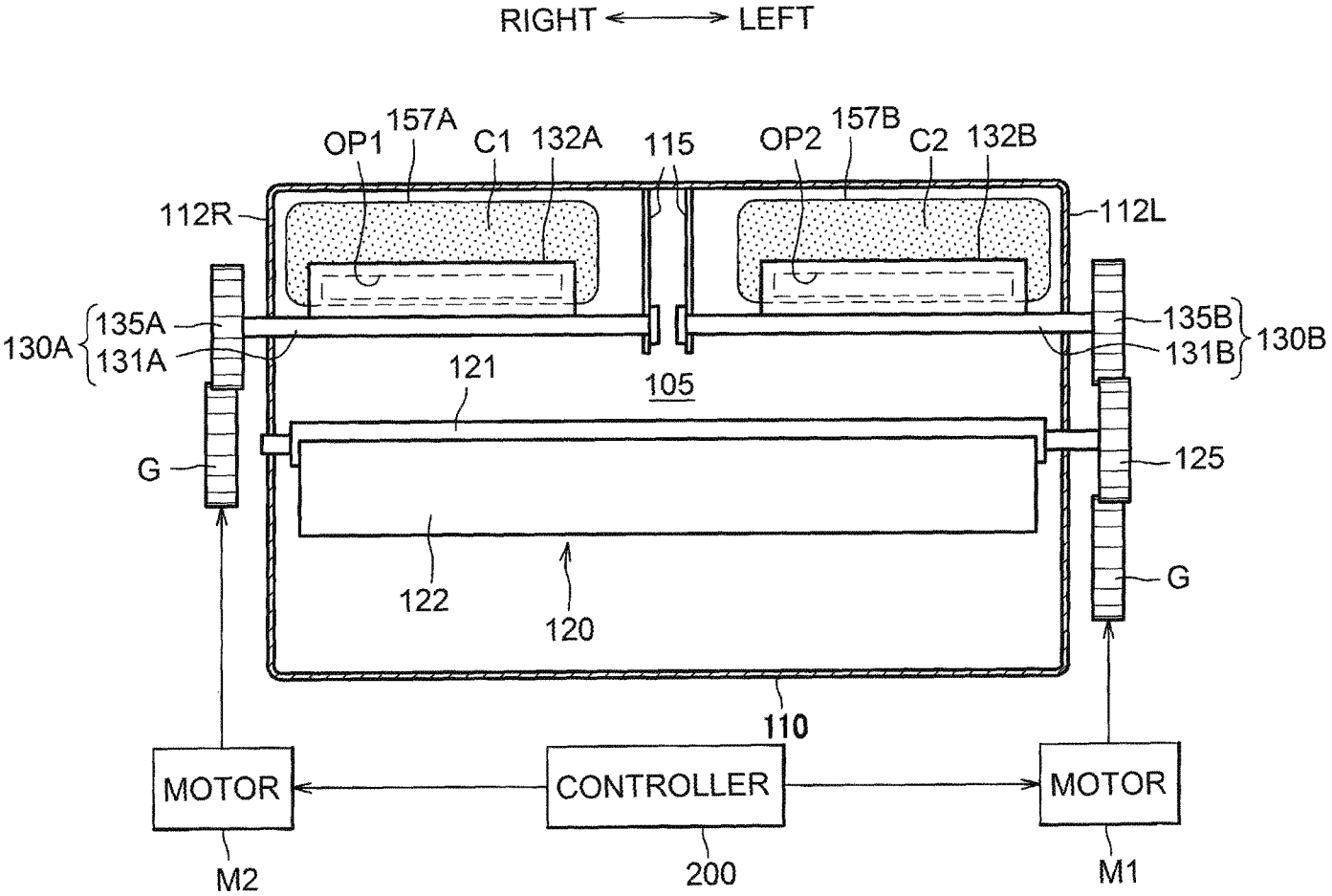
FIG. 7 is a sectional view of a developer storage chamber of a developer cartridge for explaining driving control of a plurality of opening mechanisms in another alternative embodiment according to one or more aspects of the disclosure.

As illustrated in FIG. 7, a first flexible container 157A and a second flexible container 157B are accommodated in the developer storage chamber 105 of the housing 110. The sealed first flexible container 157A stores a substance C1. The sealed second flexible container 157B stores a substance C2. An opening mechanism 130A is provided for the first flexible container 157A, and another opening mechanism 130B is provided for the second flexible container 157B. The opening mechanisms 130A and 130B are driven independently.

The opening mechanism 130A includes a shaft 131A and an input gear 135A. The opening mechanism 130B includes a shaft 131B and an input gear 135B. The shafts 131A and 131B and the input gears 135A and 135B may be the movable portions, each of which is configured to operate in response to input of a driving force transmitted from the outside of the housing 110. The shaft 131A is attached with a sheet 132A as the seal member. The shaft 131B is attached with a sheet 132B as the seal member. The sheet 132A removably closes the outlet OP1 of the flexible container 157A. The sheet 132B removably closes the outlet OP2 of the flexible container 157B.

The shaft 131A has one end portion that is rotatably supported by the sidewall 112R of the housing 110, and the other end portion that is rotatably supported by a bearing plate 115. Similar to this, the shaft 131B has one end portion that is rotatably supported by the sidewall 112L of the housing 110, and the other end portion that is rotatably supported by another bearing plate 115. The bearing plates 115 are disposed inside the housing 110.

The input gear 135A is configured to receive a driving force inputted from a motor M2. The input gear 135B is configured to receive a driving force inputted from a motor M1. The controller 200 controls a driving timing of each of the motors M1 and M2. In response to input of a driving force to an input gear (e.g., the input gear 135A or 135B), a corresponding shaft (e.g., the shaft 131A or 131B) starts rotating. Thus, a sheet (e.g., the sheet 132A or 132B) attached to the shaft is pulled to be removed from a corresponding outlet (e.g., the outlet OP1 or OP2) to open the outlet, and is withdrawn by winding around the shaft.

As illustrated in FIG. 7, for example, the second flexible container 157B is configured to be opened by rotation of the motor M1 that drives the agitator 120. In a case where the first and second flexible containers 157A and 157B store the respective substances C1 and C2 that are both toner, the laser printer 1 and the developer cartridge 100 according to this alternative embodiment operate as described below.

When a not-yet-used developer cartridge 100 is started to be used, i.e., when image formation starts using a not-yet-used developer cartridge 100 by control of the controller 200, the agitator 120 (i.e., the agitator shaft 121) starts rotating by input of a driving force of the motor M1 to the agitator gear 125. With this rotation of the agitator 120, the input gear 135B meshing with the agitator gear 125 rotates to rotate the shaft 131B.

In response to this, the sheet 132B that closes the outlet OP2 of the second flexible container 157B is removed therefrom to open the outlet OP2. Thus, the substance C2 (e.g., toner) is released to the developer storage chamber 105. The released toner C2 is agitated by the agitation sheet 122 of the rotating agitator 120.

When toner C2 is running low, the controller 200 drives the motor M2 to rotate the shaft 131A via the input gear 135A at an appropriate timing. Thus, the sheet 132A that closes the outlet OP1 of the first flexible container 157B is removed therefrom to open the outlet OP1 to release the substance C1 (e.g., toner) to the developer storage chamber 105 therethrough.

According to this alternative embodiment, while some (e.g., toner C2 released from the second flexible container 157B that has been opened prior to the first flexible container 157A) of the whole amount of toner stored in the developer cartridge 100 is used, the remaining (e.g., toner C1 stored in the first flexible container 157A) of the whole amount of toner may be unused and stored in the sealed first flexible container 157A. The remaining toner C1 may be released to the developer storage chamber 105 at an appropriate timing before toner C2 being used is exhausted. With this configuration, deterioration effects of time on toner may be reduced with saving time and effort for replacing the developer cartridge 100 with a new one. Therefore, as compared with known developer cartridges, the developer cartridge 100 may provide higher quality toner for image formation.

According to this alternative embodiment, only half of the whole amount of toner stored in the developer cartridge 100 is released to the developer storage chamber 105 at a first opening operation. Therefore, as compared with a case where an agitator agitates and conveys the whole amount of toner stored in the developer cartridge 100, this configuration may enable the agitator 120 to be driven with a less torque.

Such opening mechanisms that are configured to open their corresponding flexible containers at the respective arbitrary timings according to this alternative embodiment may also be applied to other flexible containers positioned in another arrangement. In this case, for the flexible container to be opened prior to the others, the agitator 120 may serve as both the movable portion and the seal member similar to the illustrative embodiment illustrated in FIGS. 2 and 3.

Using the opening mechanisms that are configured to be driven individually by different drive sources to open their corresponding flexible containers at the respective arbitrary timings may provide one or more effects described below. As described in the third alternative embodiment, one or more of flexible containers may store a substance other than toner (e.g., developer), or flexible containers may store respective different type developers. Therefore, developer having optimum composition or developer having optimum quality may be prepared to compensate for the deterioration effects of time on the image forming performance by combination with an appropriate open timing.

For example, compensation may be made for deterioration effects of time on a key component that may cause an adverse effect on quality of an image to be formed. In one example, with the expectation that the charging performance of the developing roller 107 would be decreased over time, developer having higher electrostatic property may be stored in one of flexible containers and released at a later timing. In another example, with the expectation that free silica would remain in the developer storage chamber 105 during development, developer containing less silica than developer to be released at an earlier timing may be stored in one of flexible containers and released at a later timing. Thus, the ratio of silica to toner may be kept nearly at the initial optimum ratio.

In another example, in a case where a developer cartridge stores two-component developer, with the expectation that carrier would remain in the developer storage chamber 105 with the use of toner, developer in which the containing amount of toner is higher than developer to be released at an earlier timing or developer containing toner only may be stored in one of flexible containers and released at a later timing.

In another example, a developer cartridge may further include a relatively small capacity flexible container that stores reserve toner. If a user does not have a developer cartridge stock on hand when toner of the developer cartridge being currently used is exhausted, the reserve toner may be used until the user obtains a replacement developer cartridge. In another case, if toner is exhausted during image formation, the ongoing image formation may be completed using the reserve toner without replacement of the currently-used developer cartridge with a new one.

While the disclosure has been described in detail with reference to the specific embodiments thereof, these are merely examples, and various changes, arrangements and modifications may be applied therein without departing from the spirit and scope of the disclosure.

In the illustrative embodiment and the alternative embodiments, the flexible containers are separately provided. Nevertheless, in other embodiments, for example, a single flexible container may have a plurality of storage chambers that are separately sealed. In this case, each of the storage chambers may have an outlet, and a seal member is provided for each storage chamber to close its outlet. In this example, also, the outlets of the respective storage chambers may be opened at respective different timings.

In the illustrative embodiment and the alternative embodiments, a flexible container has a preformed opening (e.g., an outlet) and a seal member closes the opening. Nevertheless, in other embodiments, for example, a flexible container may have an easy-to-tear portion instead of a preformed outlet. The easy-to-tear portion may be torn easier than the other portion of the flexible container, along a predetermined line that defines an outline of an outlet to be formed. The easy-to-tear portion may be pulled by an opening mechanism (e.g., a movable portion) to form an outlet in the flexible container to open the flexible container.

In other embodiments, for example, using one or more of a cutter, an elastic member, and an urging member (e.g., a spring), a flexible container may be left in the developer storage chamber without interference with operation of a developer cartridge after the flexible container is opened. In one example, the flexible container may be rolled around a shaft. In another example, the flexible container may be held against one of inner walls of a housing. In still another example, the flexible container may be reduced its size.

In a case where a seal member is provided for an outlet of each flexible container, each opening mechanism is configured to open a corresponding one of the flexible containers as with the alternative embodiment illustrated in FIG. 7. On the other hand, in a case where a common seal member is provided for a plurality of flexible containers to close their outlets OP, the plurality of flexible containers are opened at substantially the same timing as with the illustrative embodiment illustrated in FIG. 3. This configuration may thus achieve reduced parts count and reduced manufacturing costs.

In the illustrative embodiment and the alternative embodiments, an opening mechanism is configured to open one or more corresponding flexible containers automatically at a predetermined timing by control of the controller 200. Nevertheless, in other embodiments, for example, a flexible container that stores reserve toner may be opened manually at an arbitrary timing.

In the second and third alternative embodiments (refer to FIGS. 5 and 6), the flexible containers have different capacities appropriate for usage or storage space or both. Nevertheless, in other embodiments, for example, all flexible containers may have the same storage capacity or all flexible containers may have an identical shape, and the flexible containers may be positioned at their predetermined positions with being deformed. Providing commonality among the flexible containers may achieve reduced costs of mass production.

In the illustrative embodiment and the alternative embodiments, the disclosure has been applied to the developer cartridge including the developing roller and the supply roller. Nevertheless, in other embodiments, for example, the disclosure may be applied to a process cartridge that includes a photosensitive member and a developer cartridge attachable to and detachable from a developing device.

In the illustrative embodiment and the alternative embodiments, the laser printer 1 is an example of the image forming apparatus in which the developer cartridge according to one or more aspects of the disclosure is used. Nevertheless, in other embodiments, for example, the disclosure may be applied to a developer cartridge that may be used in another image forming apparatus, e.g., a copying machine or a multifunction device.

What is claimed is:

1. A developer cartridge comprising:

a first flexible container openably sealed;

a second flexible container openably sealed;

a housing accommodating the first flexible container and the second flexible container, and a seal member, wherein each of the first flexible container and the second flexible container has an outlet openably closed by the seal member, wherein the seal member includes:

a first seal member openably closing the outlet of the first flexible container; and a second seal member openably closing the outlet of the second flexible container, and wherein at least one of the first flexible container and the second flexible container stores developer.

2. The developer cartridge according to claim 1, wherein the seal member is further configured to agitate the developer released through the outlet of the at least one of the first flexible container and the second flexible container.

3. The developer cartridge according to claim 1, wherein the first seal member is configured to agitate the developer released through the outlet of the first flexible container, and the second seal member is configured to agitate the developer released through the outlet of the second flexible container.

4. The developer cartridge according to claim 1, wherein the seal member is a sheet, and the first seal member is a part of the sheet and the second seal member is another part of the sheet.

5. The developer cartridge according to claim 1, wherein the first flexible container stores a first object, and the second flexible container stores a second object that is the same as the first object.

6. The developer cartridge according to claim 1, wherein the first flexible container stores a first object, and the second flexible container stores a second object that is different from the first object.

7. The developer cartridge according to claim 6, further comprising a breathable container accommodated in the second flexible container, wherein the first object is developer, and wherein the breathable container stores the second object.

8. The developer cartridge according to claim 1, wherein the first flexible container has a different storage capacity from the second flexible container.

9. The developer cartridge according to claim 1, wherein the first flexible container has the same storage capacity as the second flexible container.

10. The developer cartridge according to claim 1, wherein the first flexible container stores an object whose amount is different from the second flexible container.

11. The developer cartridge according to claim 1, wherein the first flexible container has a different shape from the second flexible container.

12. The developer cartridge according to claim 1, further comprising an agitator including an agitator shaft and an agitation sheet fixed to the agitator shaft, wherein the agitation sheet is attached to the at least one of the first flexible container and the second flexible container and seals an outlet of the at least one of the first flexible container and the second flexible container, wherein the agitation sheet is configured to be removed from the at least one of the first flexible container and the second flexible container upon rotation of the agitator shaft, and wherein the agitation sheet is configured to agitate the developer in the housing during the rotation of the agitator shaft after being removed from the at least one of the first flexible container and the second flexible container.

13. The developer cartridge according to claim 1, wherein the first seal member is a single sheet and the second seal member is a single sheet different from the first seal member.

14. A developer cartridge comprising:

a first flexible container openably sealed;

a second flexible container openably sealed;

a housing accommodating the first flexible container and the second flexible container; and an opening mechanism configured to open the first flexible container and the second flexible container at a predetermined timing, wherein at least one of the first flexible container and the second flexible container stores developer.

15. The developer cartridge according to claim 14, further comprising an opening mechanism configured to open the first flexible container and the second flexible container at substantially the same timing.

16. The developer cartridge according to claim 14, further comprising an opening mechanism configured to open the first flexible container and the second flexible container at respective different timings.

17. The developer cartridge according to claim 14, wherein the opening mechanism includes a movable portion configured to operate in response to input of a driving force transmitted from outside of the housing, and wherein the movable portion is configured to open the at least one of the first flexible container and the second flexible container.

18. The developer cartridge according to claim 17, further comprising a seal member, wherein the movable portion includes:

a gear configured to input the driving force to the movable portion; and a shaft connected to the gear and configured to take up the seal member therearound.

19. The developer cartridge according to claim 17, wherein the movable portion includes:

a first movable portion for the first flexible container; and a second movable portion for the second flexible container, wherein the first movable portion and the second movable portion are configured to operate in connection with each other.

20. The developer cartridge according to claim 17, wherein the movable portion includes:

a first movable portion for the first flexible container; and a second movable portion for the second flexible container, wherein the first movable portion and the second movable portion are configured to operate independently of each other.

21. The developer cartridge according to claim 17, further comprising an agitator configured to agitate the developer released and stored in the housing, wherein the agitator constitutes the movable portion.

22. The developer cartridge according to claim 21, wherein the first flexible container and the second flexible container are aligned with each other in a direction in which a rotation axis of the agitator extends.

23. The developer cartridge according to claim 21, wherein the first flexible container and the second flexible container are aligned with each other in a direction orthogonal to a direction in which a rotation axis of the agitator extends.

24. The developer cartridge according to claim 14, further comprising a seal member, wherein each of the first flexible container and the second flexible container has an outlet openably closed by the seal member.

25. The developer cartridge according to claim 24, wherein the seal member is a sheet.

* * * * *